US005425506A

United States Patent [19]

Carey

[11] Patent Number: 5,425,506

[45] Date of Patent: Jun. 20, 1995

[54] CONDUCTIVE PLASTIC TIP GUARD FOR HYDRAULIC SPRAY GUN

[75] Inventor: Danuta H. Carey, Stockholm, N.J.

[73] Assignee: Titan Tool Inc., Oakland, N.J.

[21] Appl. No.: 317,462

[22] Filed: Oct. 4, 1994

[51] Int. Cl.[6] ..... B05B 15/04

[52] U.S. Cl. ..... 239/288.3; 239/288

[58] Field of Search ..... 239/288, 288.3, 288.5, 239/DIG. 22, 103, 119, 691

[56] References Cited

U.S. PATENT DOCUMENTS

| | | | |
|---|---|---|---|
| 3,952,955 | 4/1976 | Clements | 239/288.5 |
| 4,239,157 | 12/1980 | Fasth | 239/288.5 |
| 4,537,355 | 8/1985 | Calder | 239/288.3 |
| 4,635,850 | 1/1987 | Leisi | 239/288.3 |
| 4,637,551 | 1/1987 | Seeger, Jr. et al. | 239/288.5 |
| 4,685,621 | 8/1987 | Scherer et al. | 239/288 |
| 5,280,853 | 1/1994 | Perret, Jr. | 239/288.3 |
| 5,285,965 | 2/1994 | McCutcheon et al. | 239/288 |

FOREIGN PATENT DOCUMENTS

| | | | |
|---|---|---|---|
| 1114598 | 12/1981 | Canada | 239/288 |
| 2018163 | 10/1979 | United Kingdom | 239/288 |
| 2142558 | 1/1985 | United Kingdom | 239/119 |

*Primary Examiner*—Andres Kashnikow
*Assistant Examiner*—Christopher G. Trainor
*Attorney, Agent, or Firm*—Bucknam and Archer

[57] ABSTRACT

There is provided an electrically conductive plastic tip guard for a hydraulic or airless spray gun adapted for the hydraulic atomization and spraying of fluid such as paint. The electrically conductive plastic tip guard when in contact with a grounded surface dissipates to ground the static electricity generated by the passage of the fluid through the spray tip.

7 Claims, 2 Drawing Sheets

CONDUCTIVE PLASTIC TIP GUARD FOR HYDRAULIC SPRAY GUN

Figure 1:
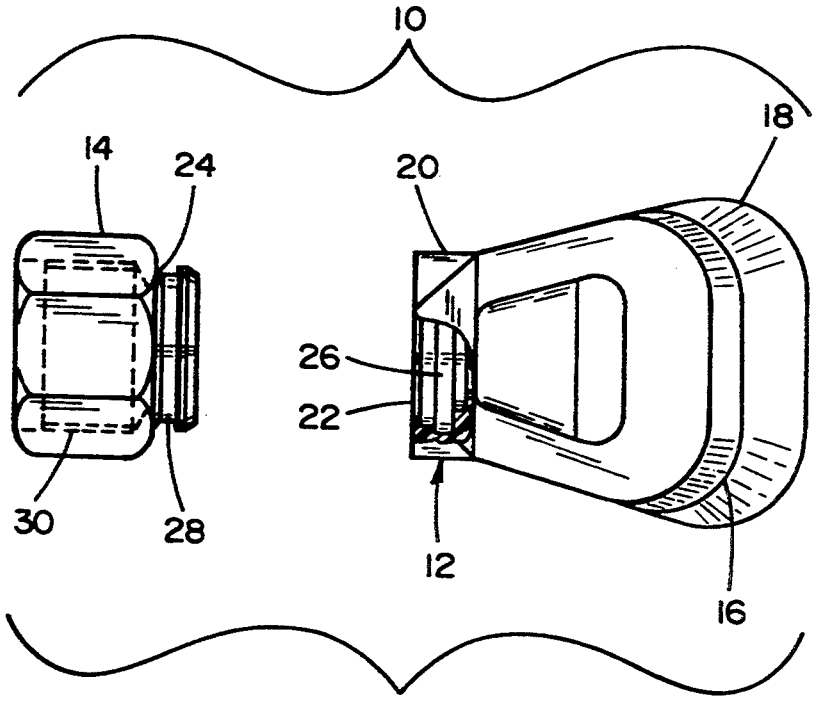

The present invention relates generally to an electrically conductive plastic tip guard for a spray gun and, more particularly, it relates to an electrically conductive plastic tip guard for a spray gun which is used in hydraulic paint spraying.

One method of painting which is used widely is hydraulic paint spraying wherein the liquid paint is delivered to the operator held spray gun under sufficient high pressure that upon exiting the spray tip of the spray gun it is atomized into a spray suitable for spray painting objects. While this type or method of spray painting has certain advantages it is also burdened with certain disadvantages, one of which relates to safety. It has long been recognized as necessary in order to insure the safety of the operator of such equipment to provide a tip guard for the spray gun so that the operator does not inadvertently inject himself or another with the high pressure paint as it exits the spray tip. An example of such a spray tip guard can be found in U.S. Pat. No. 3,952,955, to Clements, granted Apr. 27, 1976. Such spray tip guards are generally Y-shaped with the flattened diverging ears thereof generally parallel to the fan of the spray pattern and extending sufficiently forward of the spray tip to insure against injection of the high pressure fluid into the human body. In practice it has been found that a spray tip guard of a few inches or less in length is sufficient to avoid such inadvertent injection since the fan spray begins to expand to such an extent as to not pose an injection problem at a distance of about 5/8 of an inch from the spray tip.

Another safety problem connected with the hydraulic paint spraying method relates to a fire or explosion hazard. As the high pressure liquid passes through the metallic spray gun and is discharged from the tip of the spray gun, static electricity is generated by the high speed of the liquid passing through the spray tip. If volatile solvents are used in the paint or other liquid being sprayed, the danger of a spark, say from any static electricity build-up, igniting the vaporized solvents is present. During the spraying operation itself this danger is minimal or non-existent since the spray gun is grounded through the operator so that the static electricity generated during operation does not build up in the spray gun. However, the greatest danger exists during the clean-up operation when the unused paint remaining in the system and the volatile solvents used for flushing the system are discharged through the spray gun and into a receptacle such as a container. During this clean-up operation the operator generally positions the spray gun to discharge into the container with the trigger locked in the ON position so that the operator is thereby free to perform other clean-up chores. Operators are cautioned during this clean-up operation by the spray gun manufacturers to be sure that the spray gun is well grounded against a metal container into which the unused paint and cleaning fluid is discharged so that any static electricity generated during this operation is transferred to ground before any build-up can occur. Operators are also cautioned and instructed to remove the spray tip from the spray gun during this clean-up operation in order to reduce the hazards of static electricity build-up.

Manufacturers of such paint spray equipment caution operators and users thereof as to the necessity of exercising care in the handling and operation of such equipment including the steps to be taken to avoid fire and explosion hazards. However, no matter how thorough such safety instructions are, ways and means are continually being sought to lessen or minimize the risk of accidental fire resulting from sparks due to static electricity build-up.

It is, therefore, a primary object of the present invention to augment the ability of the spray gun of a hydraulic paint spray system to discharge to ground any static electricity generated during operation thereof so as to avoid static electricity build-up in the spray gun.

The above object is accomplished in accordance with the present invention by providing a plastic, generally Y-shaped, tip guard for a spray gun adapted for the hydraulic atomizing and spraying of liquid such as paint wherein the plastic tip guard is formed of a material which is electrically conductive so that any static electricity generated on account of the passage of the fluid through the spray gun may be discharged to ground through the spray gun and the tip guard.

Other objects and features of the present invention will become apparent from the following detailed description thereof when considered in connection with the accompanying drawings. It is to be understood, however, that the drawings are designed as an illustration only and not as a definition of the limits of the invention.

Figure 2:
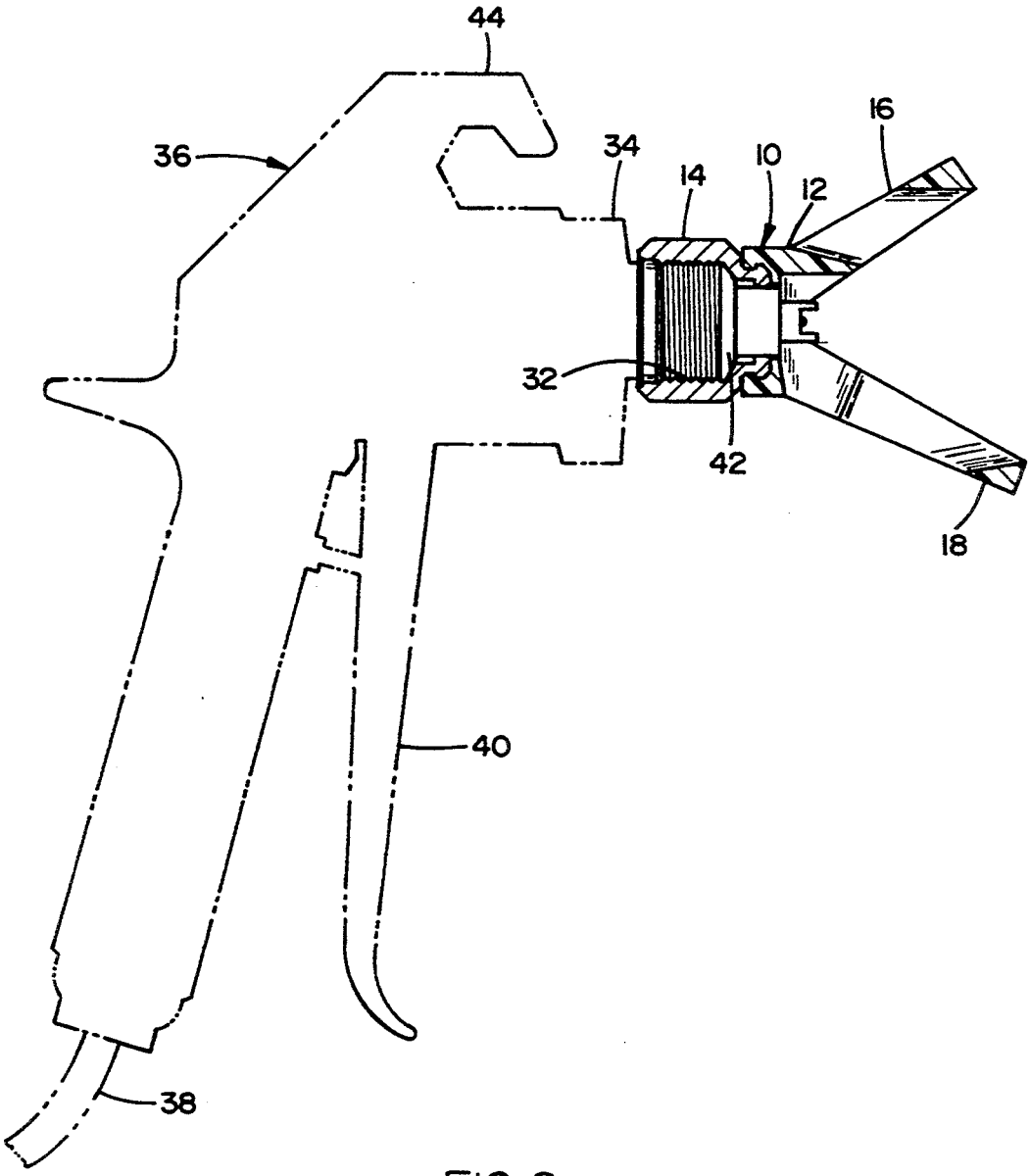

In the drawings, wherein similar reference characters denote similar elements throughout the several views:

FIG. 1 is a top plan view of the tip guard assembly according to the present invention; and FIG. 2 is a side elevational view, partly in cross section, of a hydraulic airless spray gun having the conductive plastic tip guard according to the present invention mounted thereon.

Now turning to the drawings, there is shown in FIG. 1 a tip guard assembly, generally designated 10, including a plastic tip guard, designated 12, and a retaining nut, designated 14. Plastic tip guard 12, is substantially Y-shaped having diverging ears, designated 16 and 18, extending forwardly from a base 20. Base 20 has a centrally disposed axial opening, designated 22, therein which receives a forward extension, designated 24, of retaining nut 14 therein. Tip guard 12 is rotatably mounted to retaining nut 14 by the engagement of annular boss 26 disposed in opening 22 with annular groove 28 disposed on extension 24 of retaining nut 14. Retaining nut 14 is provided with internal threads, designated 30, adapted for threaded engagement with external threads, designated 32, at the forward end of barrel 34 of hydraulic spray gun 36 (shown in phantom), as clearly seen in FIG. 2.

As clearly seen in FIG. 2, hydraulic spray gun 36 communicates with a source of high pressure fluid, such as paint, via flexible hose 38 (shown in phantom). The high pressure fluid is conducted through spray gun 36 to the forward end of barrel 34 thereof and the passage therethrough is controlled by trigger 40 of the spray gun. A spray tip, designated 42, is securely fastened to the forward end of barrel 34 by means of retaining nut 14. The forwardly extending ears 16 and 18 of plastic tip guard 12 can be axially rotated and thus adjusted with respect to the fan spray issuing from spray tip 42 so as not to interfere therewith. Spray gun 36 is also provided with a hook member, designated 44, for ease in hanging spray gun 36 when it is temporarily not in use during the painting operation.

Generally, hydraulic or airless spray gun 36 is constructed of metal which is a highly conductive material and which readily passes any static electricity generated by the passage of the fluid paint therethrough to ground when the spray gun is grounded. As noted above, such grounding of spray gun 36 is accomplished during operation thereof through the operator. However, during clean-up, the operator usually hangs spray gun 36 by its hook member 44 on the edge of a metal container with the trigger in the ON position thus discharging any remaining paint in the system and flushing or cleaning fluids into the container. By constructing plastic tip guard 12 of a conductive thermoplastic material rather than a non-conductive thermoplastic material, as is now done, the conductive surface of spray gun 36 is enhanced or augmented. Thus, by plastic tip guard 12 coming in contact with the metal surface of the container into which the spray gun is discharged an additional surface area is provided for grounding spray gun 36.

Heretofore, plastic tip guards have generally been formed by the injection molding of a thermoplastic material consisting of ABS and nylon. Although this plastic material or any other thermoplastic material other than fluroplastics can be made conductive, at present generally nylon is used in the making of conductive plastic material. In order to make thermoplastic material conductive, metal strands, metal flakes, metal powder, carbon fibers or carbon black are added to the plastic and the plastic is then molded to the desired shape. In the present case, it is preferred to mix carbon black with the raw thermoplastic material, such as nylon, because carbon black impregnated plastic is economical for use in conductive plastic tip guards according to the present invention.

It is to be understood that the foregoing general and detailed descriptions are explanatory of the present invention and are not to be interpreted as restrictive of the scope of the following claims.

What is claimed is:

1. In a spray tip guard for use with a hydraulic or airless spray gun having a spray tip thereon, the spray tip guard being mounted on a retaining nut adapted for threaded engagement with the barrel of the spray gun to retain the spray tip thereon the spray tip guard is substantially Y-shaped having diverging ears extending forwardly from the spray tip and a base member rotatably mounted on the retaining nut, wherein the improvement comprises:

said spray tip guard being formed of an electrically conductive thermoplastic material whereby any static electricity generated during operation of the spray gun is dischargeable to ground through said spray tip guard.

2. The spray tip guard as defined in claim 1, wherein said spray tip guard is formed of a thermoplastic material having metal strands therein.

3. The spray tip guard as defined in claim 1, wherein said spray tip guard is formed of a thermoplastic material having metal flakes therein.

4. The spray tip guard as defined in claim 1, wherein said spray tip guard is formed of a thermoplastic material having metal powder mixed therein.

5. The spray tip guard as defined in claim 1, wherein said spray tip guard is formed of a thermoplastic material having carbon fibers therein.

6. The spray tip guard as defined in claim 1, wherein said spray tip guard is formed of a thermoplastic material having carbon black mixed therein.

7. The spray tip guard as defined in claim 1, wherein said spray tip guard is formed of nylon material having carbon black mixed therein.

* * * * *